US007655114B2

(12) United States Patent
Kohnen et al.

(10) Patent No.: US 7,655,114 B2
(45) Date of Patent: Feb. 2, 2010

(54) METHOD AND DEVICE FOR CALENDERING A PAPER WEB

(75) Inventors: Josef Kohnen, Toenisvorst (DE); Dirk Cramer, Duisburg (DE)

(73) Assignee: Voith Paper Patent GmbH, Heidenheim (DE)

( * ) Notice: Subject to any disclaimer, the term of this patent is extended or adjusted under 35 U.S.C. 154(b) by 235 days.

(21) Appl. No.: 11/111,932

(22) Filed: Apr. 22, 2005

(65) Prior Publication Data

US 2005/0235840 A1 Oct. 27, 2005

(30) Foreign Application Priority Data

Apr. 24, 2004 (DE) ..... 10 2004 020 069

(51) Int. Cl.
*D21G 1/00* (2006.01)
*B30B 3/04* (2006.01)

(52) U.S. Cl. ..... 162/361; 162/118; 162/205; 162/206; 100/162 R; 100/40; 100/47; 100/74; 100/77

(58) Field of Classification Search ..... 162/204–207, 162/358.1, 359.1, 361, 360.3, 118, 122; 100/161, 162 R, 163 R, 164, 165, 163 A, 100/166, 162 B, 158 R, 73–77, 47, 40
See application file for complete search history.

(56) References Cited

U.S. PATENT DOCUMENTS 5,251,551 A * 10/1993 Abe et al. ..... 100/307
5,609,098 A 3/1997 Abe et al.
5,619,807 A * 4/1997 Conrad ..... 34/414
6,038,789 A * 3/2000 Kaihovirta et al. ..... 34/448
6,254,725 B1 7/2001 Lau et al.
6,500,305 B1 * 12/2002 Winheim et al. ..... 162/207
6,886,454 B1 * 5/2005 Torvi et al. ..... 100/35
7,059,066 B2 * 6/2006 Maurer ..... 34/446
2002/0096277 A1 7/2002 Lau et al.

(Continued)

FOREIGN PATENT DOCUMENTS

DE 4037166 12/1991

(Continued)

OTHER PUBLICATIONS

Smook, Gary A., Handbook for Pulp and Paper Technologists, pp. 272-275, 294-296 (1992).*

(Continued)

*Primary Examiner*—Eric Hug
(74) *Attorney, Agent, or Firm*—Greenblum & Bernstein, P.L.C.

(57) ABSTRACT

The present invention shows a process and device of calendering a web. The process includes drying the web and winding the web at the end of a production section. The process includes transporting the wound web to at least one off-line calender, unwinding the web and passing the web through the at least one off-line calender. Further, the process includes treating the web between drying and winding of the web in at least one on-line calendering unit. Further still, the process includes at least one on-line calendering unit includes at least one nip defined by at least one hard roller. The instant abstract is neither intended to define the invention disclosed in this specification nor intended to limit the scope of the invention in any way.

24 Claims, 1 Drawing Sheet

U.S. PATENT DOCUMENTS

2003/0150579 A1* 8/2003 Maurer ..... 162/204

FOREIGN PATENT DOCUMENTS

| | | | |
|---|---|---|---|
| DE | 94 14 963.1 | | 12/1994 |
| DE | 197 15 345 | A1 | 10/1998 |
| DE | 10084571 | | 5/2002 |
| DE | 101 10 309 | A1 | 9/2002 |
| DE | 102 06 333 | C1 | 7/2003 |
| DE | 102 05 220 | A1 | 8/2003 |
| DE | 69915647 | | 2/2005 |
| DE | 699 19 599 | T2 | 5/2005 |
| EP | 0672785 | | 9/1995 |
| EP | 0726353 | | 8/1996 |
| GB | 775 300 | | 5/1957 |
| WO | 97/13035 | | 4/1997 |
| WO | 99/64672 | | 12/1999 |
| WO | 01/32982 | | 5/2001 |
| WO | 01/98585 | | 12/2001 |

OTHER PUBLICATIONS

Das Papierbuch, Handbuch der Papierherstellung, EPN Verlag, 3994 DB Houten, Niederlande, 1.Auflage, Chapt. 2, "Kalander und Glättwerk," pp. 401-429, 1999.

Baumgarten, "Über die thermomechanische Oberflächenumformung und Kalibrierung von Papier und Karton," XVII. Eucepa-Konferenz, Oct. 10-14, 1977, Manuscript No. 18-31, II, pp. 189-204.

* cited by examiner

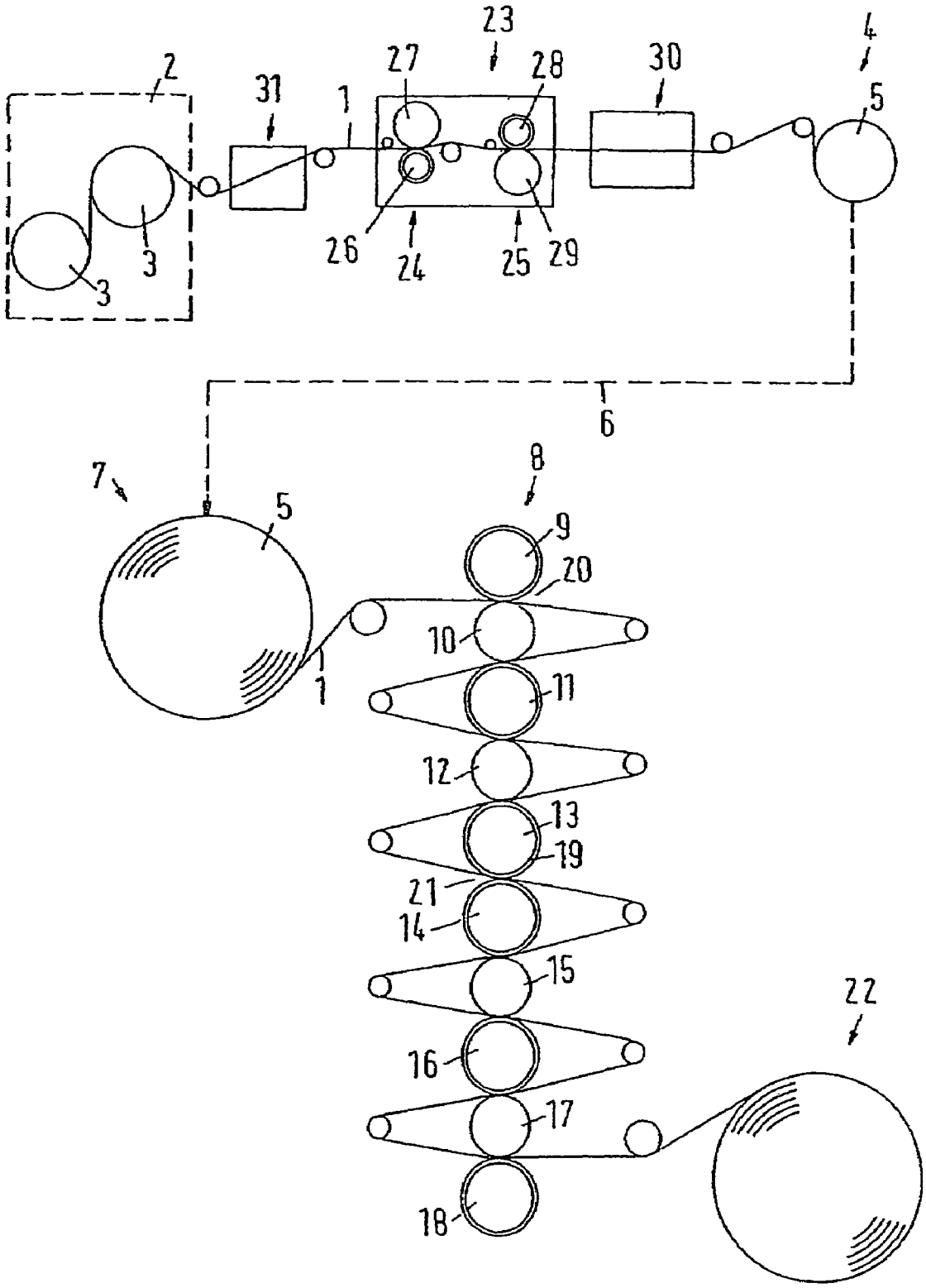
23
4
2
27
28
30
31
1
5
3
3
26
24
25
29
6
7
8
5
9
20
10
1
11
12
13
19
21
14
15
22
16
17
18

METHOD AND DEVICE FOR CALENDERING A PAPER WEB

CROSS-REFERENCE TO RELATED APPLICATIONS

The present application claims priority under 35 U.S.C. §119 of German Patent Application No. 10 2004 020 069.6, filed on Apr. 24, 2004, the disclosure of which is expressly incorporated by reference herein in their entireties.

BACKGROUND OF THE INVENTION

1. Field of the Invention

The invention relates to a method for calendering a paper web, which is wound after drying performed at the end of a production section, and then transported to an off-line calender, unwound and passed through the calender.

2. Discussion of Background Information

A method for calendering a paper web is used in conjunction with the manufacture of high-quality papers, such as SC-A papers or SC-A-Plus papers, in which high demands are imposed on the quality of the surface of the web. To ensure adequate printability in the gravure process, certain aspects of paper surface qualities are required.

In order to ensure such quality, off-line calenders having at least ten rollers are used today. Because the off-line calenders operate slower than the paper machines supplying them, a single paper machine often may have two off-line calenders. In contrast to this, SC-B papers are customarily produced on-line, such that the paper web is passed through a 2×2-roller soft calender before being wound. However, to reach the desired surface quality for SC-A or SC-B-Plus papers the above process cannot be utilized.

As the operating speeds of paper machines increase, corresponding changes are needed to the off-line calenders, so the off-line calenders are able to keep up with production. The paper manufacturing industry as a rule, is interested in increasing the speeds of production. However, a consequence of increasing the speed of production is line load and/or surface temperature of the heated rollers have to be increased to meet quality control objectives. This change in the operating parameters may have negative effects on the web, such as a higher calender blackening. Increasing the speed of production could also require operating the calender with more rollers, such as 12 rollers, resulting in increased overall costs of manufacturing.

In extreme cases, the installation of a third off-line calender may be necessary, which again result in increased manufacturing cost. In particular, the increased costs would include the preparation of a standing surface for the third calender.

SUMMARY OF THE INVENTION

The instant invention is directed to adapt the calendering in an off-line calender to meet increases in paper machine speeds.

Increasing the paper machine speeds can be achieved by pre-calendering the paper web between the drying and winding in a calendering unit, such that at least one nip is defined by a single hard roller.

Pre-calendering in the on-line calendering unit before winding does not negatively effect the glazing during the intermediate storage of the paper web on the drum, rather the paper web enters the off-line calender with increased glazing. The paper machines can run at higher speeds with off-line calender production parameters that achieve positive calendering production results, even though the paper machines had originally been envisaged to operate at a lower calender speed. An advantage of pre-calendering in the on-line calendering unit is an increased speed of the off-line calender, which adapts to an increasing speed of the paper machine. Resulting in a paper web that does not have any impairments in the surface quality or other disadvantages, such as calender blackening. Thus, the overall effect to the paper machine process is an improvement to the paper web.

At least one roller defining the nip is heated to a surface temperature in the range from 60 to 300° C. The advantage of applying heat to at least one roller provides an easier glazing process of the paper web in the calendering unit. The paper web exhibits a relatively high temperature due to the drying process preceding the pre-calendering, resulting in not having to supply high energy as is currently practiced in the prior art. Thus, pre-calendering provides a savings in energy in the overall production process.

The paper web can be subjected to a line load not exceeding 1,000 N/mm in the nip. The line load is selected in relation to a desired result.

The paper web can be moistened after passing through the calendering arrangement and before winding. If the paper web is subjected to increased pressure, and/or increased temperature in the calendering unit, the paper web can lose moisture. Moisture can be added to the paper web to compensate for the effects of pressure and/or temperature, so that an adequately moistened paper web can then be wound. Applying the moisture at this stage of the process must not be excessively uniform. Since the paper web is wound onto a drum and remains in intermediate storage, for a period of time to transport the full drum from the paper machine outlet to the off-line calender. This period of time is long enough to allow for a certain equilibrium to be reached in the moisture of the wound paper web. The paper web may be moistened one or more times in the off-line calendering, even though the web may have been moistened in the pre-calendering unit.

The paper web can be calibrated in the calendering unit, which offers considerable advantages when winding the paper web. The winding quality of the paper increases, since the paper web is not only pre-calendered, but also corrected with respect to its profile.

A calendering unit can use different types of nips, or any combination thereof during the paper machine process. For example, nips that can be used in the calendering unit may include at least one of a soft nip, hard nip, or a broad nip. A soft nip includes a soft roller and a hard roller producing a better glaze to the paper web over the hard nip. The soft roller exhibits a surface softer than the surface of a hard roller. The soft roller generally has a roller covering made of an elastomeric plastic, such that the soft nip permits glazing with a relatively low loss of volume to the paper web. A hard nip includes two hard rollers producing a better profile correction to the paper web. A broad nip includes a shoe roller and a counter-pressure element. It is possible the calendering unit may use a combination of at least two of these types of nips. A person skilled in the art will be able to identify the suitable type of nip by taking into account certain given peripheral conditions.

The paper web can be moistened before it enters the calendering unit and/or as it passes through the calendering unit. The present invention no longer requires reliance on the paper web exhibiting a precise target moisture after drying, which is essential for pre-calendering. The glaze on the surface of the paper web can be increased as a general rule by adding moisture during the pre-calendering.

It can be advantageous to reduce the two-sidedness of the paper web in the calendering unit to a predetermined extent. Such that, it would no longer be necessary to spend a lot of attention to the two-sidedness of the paper web, as it passes through the off-line calender. Also, it may be possible to use the same number of nips before and after the change-over nip in the off-line calender, reducing the total number of rollers to be used.

According to the invention, it may be possible to use rollers in the calendering unit of identical design to those in the off-line calender. Such that, spare rollers could be used together in the calendering unit and in the off-line calender providing the benefit of keeping stock levels and overall production costs down.

The present invention shows a process of calendering a web. The process includes drying the web and winding the web at the end of a production section. Further, the process includes transporting the wound web to at least one off-line calender, unwinding the web and passing the web through the at least one off-line calender. Further still, the process includes pre-calendering the web between drying and winding of the web in at least one on-line calendering unit. At least one on-line calendering unit includes at least one nip defined by at least one hard roller.

According to another feature of the present invention, the process shows at least one hard roller defining the nip is heated to a surface temperature in the range from 60° C. to 300° C. Further, the web is a paper web subjected to a line load not exceeding 1,000 N/mm in the nip. The process can also include moistening the web after the web passes through the on-line calendering unit and before the winding station. The process includes pre-calibrating the web in the on-line calendering unit.

According to another feature of the invention, the process shows at least one nip comprises at least one of: at least one soft nip composed of a soft roller and a hard roller; at least one hard nip composed of two hard rollers; and at least one broad nip composed of at least one shoe roller and at least one counter pressure element. Further, the process includes moistening the web before entering the on-line calendering unit and as the web passes through the on-line calendering unit. The process may also include reducing to a predetermined extent the two-sidedness of the web in the on-line calendering unit. The off-line calender comprises rollers of identical design to those in the on-line calendering unit.

The invention is directed to a machine for calendering a web. The machine includes at least one on-line calendering unit structured and arranged between at least one drying station of the machine and at least one winding station. The web is treated in the on-line calendering unit before the winding station. Further, an off-line calender is arranged to receive and treat a wound web from the winding station. Further still, at least one off-line calender unit has a second web off-line calender speed and the on-line calendering unit has a first web on-line calendering speed. Such that, the second web off-line calender speed adapts to the first web on-line calendering speed. The web is a fibrous web of the machine, and the machine is a paper machine.

According to another feature of the invention, the process includes the on-line calendering unit includes at least one nip defined by at least one hard roller. The at least one hard roller defining the nip is heated to a surface temperature in the range from 60° C. to 300° C. Further, the at least one nip is structured and arranged to exert a line load not exceeding 1,000 N/mm. Further still, the web is calibrated in the on-line calendering unit. The at least one nip comprises at least one of: at least one soft nip composed of a soft roller and a hard roller; at least one hard nip composed of two hard rollers; and at least one broad nip composed of at least one shoe roller and at least one counter pressure element.

A moistening device is arranged at least one of before and in the on-line calendering unit. Further, at least one nip comprises at least two nips arranged to reduce two-sidedness of said paper web. Further still, an off-line calender is arranged to receive and treat a wound web from the winding station. The off-line calender and the on-line calender, each include at least one soft roller and at least one hard roller of identical design.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of non-limiting example of exemplary embodiment of the present invention, and wherein:

The FIGURE illustrates a plan view of a schematic representing the procedure for calendering a paper web according to the invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The FIGURE shows schematically a paper web 1 manufactured in a paper machine 2. The paper web 1 is dried in a drying station 3 and wound onto a drum 5 at a winding station 4. Examples of higher-value paper may include SC-A or SC-A-Plus paper. Drum 5 is transported via a transport path 6, shown in the FIGURE as a broken line to an unwinding station 7. At the unwinding station 7, the paper web 1 is unwound from the drum 5 and passed through a calender 8. The FIGURE discloses ten rollers as shown as 9 to 18. However, the number of rollers are not limited to 10 rollers, rather more or less rollers may be contemplated. Of the ten rollers, the top roller 9 and the bottom roller 18 may be elastic rollers. The intermediate rollers 11, 13, 14 and 16 may also be elastic rollers which are also referred to as soft rollers. Coating 19 can be made of a plastic material, but may be made of another type of material having similar material properties of plastic.

A soft nip 20 may be formed between a soft roller 9, 11, 13, 14, 16, 18 and a hard roller 10, 12, 15, 17. A change-over nip 21 may be formed between the two soft rollers 13, 14. The under side of the paper web 1 lies against a hard roller, before passing through the change-over nip 21. After passing through the change-over nip 21, the upper side of the paper web 1 lies against a hard roller, so that two-sided glazing can be achieved.

The calender 8 may operate at a slower (or lower speed) than the paper machine 2. Losses in time during the paper machine process may be caused by installation of the drum in the unwinding station 7 and/or by the removal of a drum from the winding station 22. Consequently, two calenders 8 are generally provided as a rule for one paper machine 2.

If the speed of the paper machine 2 were to increase, even two calenders 8 may not be sufficient, if the operating speeds of the calenders 8 were not also increased. Thus, to avoid requiring a third calender 8, the operating speed of the two calenders 8 must be increased. However, as a consequence of increasing the speed of the calender 8, the line load and/or the surface temperature of the heated hard rollers 10, 12, 15, 17 must be increased to achieve the quality targets for the web, such as roughness and glazing. Moreover, further disadvantages can arise, for example a higher degree of calender blackening.

One alternative to increasing the speed of the calender 8 may be to increase the number of rollers in the calender 8 from ten to twelve.

To avoid further above noted drawbacks, the instant invention arranges a calendering unit 23 between the drying station 3 of the paper machine 2 and the winding station 4. The calendering unit 23 may include two roller stacks 24, 25, wherein each would include at least two rollers. Further, each roller stack might include at least one soft roller 26, 28, one hard roller, and a hard heated roller 27, 29. The paper web would pass through the two roller stacks 24, 25 in such a way that the first upper side of the paper web lies against the hard roller 27, and the under side of the paper web lies against the hard roller 29. Of course, the sequence of the rollers could also be reversed.

The paper web 1 can be subjected to line loads of 10 to 1,000 N/mm in the calendering device 23, in performing pre-calendering or pre-glazing. Further, when the paper web is under the above line loads, a certain degree of calibration can be performed. In particular, calibration can be brought about if a soft roller 26, 28 in one of the roller stacks 24, 25 is replaced by a hard roller (not illustrated). It is possible the hard roller provide for calibration (not illustrated) may be a profiling roller of the Nipco or Nipcorect type. It is also possible to resort to external means, such as inductive heating for the purpose of calibration.

It is also anticipated that the number of nips could be greater than the two nips presented when used for pre-calendering in the calendering unit 23. This can be achieved by executing the roller stack 24, 25 with more than two rollers, for example by arranging a correspondingly greater number of roller stacks one after the other.

A post-moistening unit 30 may be installed after the calendering unit 23 to post-moisten the paper web 1 if necessary. Since the paper web loses a certain amount of moisture in the calendering unit 23, an increase in moisture should be provided in order to ensure optimal quality conditions in the calender 8.

A moisture-increasing device 31 may be arranged in front of the calendering unit 23, which would increase the moisture of the paper web 1 as it emerges from the drying station 3 of the paper machine 2 at a relatively high temperature. It is contemplated that further moistening devices be used in the calendering unit 23, although it is not illustrated in the FIGURE.

The heated hard rollers 27, 29 in the calendering unit can be operated with surface temperatures in the range from 60 to 300° C. As mentioned above, one or more hard nips or a broad nip (formed by one roller and one shoe roller) can be used in place of the soft nips presented above.

Although not readily discernible due to drawing not being to scale, it is possible to replace the hard rollers 27, 29 from the calendering unit 23, with hard rollers 10, 12, 15, 17 of the calender 8. Further, the soft rollers 26, 28 may also be of identical execution to the two end rollers 9, 18 of the calender 8.

According to the invention, the calendering conditions in the off-line calender 8 can remain moderate or possibly reduced. The correction of the two-sidedness is effected "on-line" in the calendering unit 23, such that it is no longer necessary to pay so much attention to this feature as when the paper web passes through the calender 8. The winding quality in the winding station 4 will increase, since the paper web 1 was pre-calendered and the profile-corrected. Spare rollers can be used together in the calender 8 and in the calendering unit 23.

According to the invention, the down-times of the line due to any calendering problems would be shorter, because a way to avoid such downtimes is always available. Even in the event of all of the calenders 8 failing, it would be possible to produce a second product at a lower quality, on-line in the calendering unit 23.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process of calendering a web comprising:

drying the web;

winding the web at the end of a production section;

unwinding the web and passing the web through at least one off-line calender;

pre-calendering the web between the drying and the winding in at least one on-line calendering unit comprising at least two stacks, where each stack includes at least one hard roller;

guiding the web so that a first surface of the web lies against the at least one hard roller of one of the at least two calendering units; and guiding the web so that a second surface of the web, opposite the first surface, lies against the at least one hard roller of another of the at least two calendering units.

2. The process in accordance with claim 1, wherein at least one of the at least one hard rollers is arranged to define at least one nip, and is heated to a surface temperature in the range from 60° C. to 300° C.

3. The process in accordance with claim 1, wherein the web is a paper web subjected to a line load not exceeding 1,000 N/mm in the at least one nip.

4. The process in accordance with claim 1, further comprises pre-calibrating the web in the on-line calendering unit.

5. The process in accordance with claim 1, wherein at least one of the at least two stacks include the at least one nip comprising at least one of:

at least one soft nip composed of a soft roller and the at least one hard roller;

at least one hard nip composed of two of the at least one hard roller; and at least one broad nip composed of at least one shoe roller and at least one counter pressure element comprising the at least one hard roller.

6. The process in accordance with claim 1, further comprises moistening the web before entering the on-line calendering unit and as the web passes through the on-line calendering unit.

7. The process in accordance with claim 1, wherein the guiding of the web through the at least two stacks reduces to a predetermined extent the two-sidedness of the web in the on-line calendering unit.

8. The process in accordance with claim 1, wherein the at least one off-line calender comprises rollers of identical design to those in the on-line calendering unit.

9. The process in accordance with claim 1, further comprising moistening the web at least one of before and after passing through the at least two on-line calendering units.

10. A machine for calendering a web comprising:

at least one on-line calendering unit structured and arranged between at least one drying station of the machine and at least one winding station;

an unwinding station arranged after the at least one winding station, wherein the web is treated in said on-line calendering unit before said winding station and transported to said unwinding station without further calendering between said on-line calendering unit and said unwinding station; and at least one off-line calender arranged to receive and treat a wound web from said winding station, wherein said at least one off-line calender adapts to a speed of said on-line calendering unit.

11. The machine in accordance with claim 10, wherein the web is a fibrous web and the machine is a paper machine.

12. The machine in accordance with claim 10, wherein said on-line calendering unit includes at least one nip defined by at least one hard roller.

13. The machine in accordance with claim 12, wherein said at least one hard roller defining said nip is heated to a surface temperature in the range from 60° C. to 300° C.

14. The machine in accordance with claim 12, wherein said at least one nip is structured and arranged to exert a line load not exceeding 1,000 N/mm.

15. The machine in accordance with claim 10, wherein the web is calibrated in said on-line calendering unit.

16. The machine in accordance with claim 10, wherein the on-line calendering unit comprises at least one of:

at least one soft nip composed of a soft roller and a hard roller;

at least one hard nip composed of two hard rollers; and at least one broad nip composed of at least one shoe roller and at least one counter pressure element.

17. The machine in accordance with claim 10, further comprises a moistening device, arranged at least one of before and in said on-line calendering unit.

18. The machine in accordance with claim 12, wherein said at least one nip comprises at least two nips arranged to reduce two-sidedness of said paper web.

19. The machine in accordance with claim 10, further comprises an off-line calender arranged to receive and treat a wound web from said unwinding station; wherein said off-line calender and said on-line calender each comprise at least one soft roller and at least one hard roller of identical design.

20. The machine in accordance with claim 10, wherein the at least one off-line calender is arranged after said unwinding station.

21. A process of treating a web in the machine of claim 10 comprising:

drying the web;

pre-calendering the web after the drying;

winding the web after the pre-calendering;

unwinding the web after the winding;

calendering the web after the unwinding in at least one off-line calender.

22. A process of calendering a web comprising:

drying the web;

pre-calendering the web after the drying in at least one on-line calendering unit comprising at least two roll stacks, in which each roll stack includes a hard roller, such that a hard roller of one of the at least two roll stacks is arranged to contact an opposite side of the web than a hard roller of another of the at least two roll stack;

winding the web after the pre-calendering;

unwinding the web at a winding station after the winding;

calendering the web after the unwinding in at least one off-line calender; and moistening the web after the drying and before the pre-calendering.

23. The process of claim 22, further comprising moistening the web after the pre-calendering and before the winding.

24. The process of claim 22, further comprising:

moistening the web after the drying and before the pre-calendering; and moistening the web after the pre-calendering and before the winding.

* * * * *